US005826360A

United States Patent [19]

Herold et al.

[11] Patent Number: 5,826,360

[45] **Date of Patent: *Oct. 27, 1998**

[54] MAGAZINE FOR A FIREARM INCLUDING A SELF-CONTAINED AMMUNITION COUNTING AND INDICATING SYSTEM

[76] Inventors: Michael A. Herold, 367 High Grove Blvd., Akron, Ohio 44312; Mark D. Herold, 3980 Englewood Dr., Stow, Ohio 44224

[ * ] Notice: The term of this patent shall not extend beyond the expiration date of Pat. No. 5,642,581.

[21] Appl. No.: 778,832

[22] Filed: Jan. 6, 1997

Related U.S. Application Data

[63] Continuation-in-part of Ser. No. 580,080, Dec. 20, 1995, Pat. No. 5,642,581

[60] Provisional application No. 60/011,464 Feb. 12, 1996 and 60/027,576 Sep. 30, 1996.

[51] Int. Cl.[6] ..... F41A 9/62

[52] U.S. Cl. ..... 42/1.02

[58] Field of Search ..... 42/1.02, 1.01, 42/1.03, 50, 7

[56] References Cited

U.S. PATENT DOCUMENTS

| | | | |
|---|---|---|---|
| 784,786 | 3/1905 | Gottardi | 42/1.02 |
| 982,618 | 1/1911 | Maple et al. | 42/1.02 |
| 1,037,308 | 9/1912 | Pinkston | 42/1.02 |
| 1,202,768 | 10/1916 | Arnold . | |
| 1,251,910 | 1/1918 | Murphy | 42/1.02 |
| 2,828,568 | 4/1958 | Sakewitz | 42/1.02 |
| 3,552,053 | 1/1971 | Jarvis . | |
| 4,001,961 | 1/1977 | Johnson et al. . | |
| 4,142,313 | 3/1979 | Musgrave | 42/1.02 |
| 4,146,987 | 4/1979 | Hudson et al. . | |
| 4,216,601 | 8/1980 | Musgrave | 42/1.02 |
| 4,372,192 | 2/1983 | Lienau . | |
| 4,541,191 | 9/1985 | Morris et al. . | |
| 4,558,626 | 12/1985 | Bartolles . | |
| 4,587,756 | 5/1986 | Jakubaschk et al. . | |
| 5,005,307 | 4/1991 | Horne et al. . | |
| 5,052,138 | 10/1991 | Crain . | |
| 5,142,805 | 9/1992 | Horne et al. . | |
| 5,206,444 | 4/1993 | Oliver . | |
| 5,303,495 | 4/1994 | Harthcock . | |
| 5,307,053 | 4/1994 | Willa et al. | 42/1.01 |
| 5,425,299 | 6/1995 | Teetzel . | |
| 5,519,953 | 5/1996 | Villani | 42/1.02 |
| 5,584,136 | 12/1996 | Boland et al. | 42/50 |
| 5,592,769 | 1/1997 | Villani | 42/1.02 |
| 5,642,581 | 7/1997 | Herold et al. | 42/1.02 |

OTHER PUBLICATIONS

"Accu–Counter: Revolutionizing Firearms." brochure published by Accu–Counter, Inc. 3314 Thomas Street, Erlanger, KY 41018.

*Primary Examiner*—Charles T. Jordan
*Assistant Examiner*—Theresa M. Wesson
*Attorney, Agent, or Firm*—Oldham & Oldham Co., L.P.A.

[57] ABSTRACT

An ammunition clip or magazine for a firearm including a self-contained system for sensing the amount of ammunition contained within the magazine and visually or audibly indicating that value to the user of the firearm. The counting and indicator system may be configured to display the number of rounds remaining in the magazine itself, or the number of rounds remaining in the firearm overall (the number of ammunition rounds in the magazine plus one round in the chamber of the firearm, if applicable), or it may be configured to simply indicate that the magazine is empty or that the number of rounds remaining in the magazine is below some other predetermined threshold. The magazine may be utilized in conjunction with any suitable firearm without modifying the firearm.

17 Claims, 7 Drawing Sheets

40
U1a-U1d
+Vcc
U2
A
B
C
D
LT
BI
LE
a b c d e f g
50
52
46
48
U3
U4
U1
30
27
D1-D21
17
42a-ℓ
42ℓ
20
44
45
26
25
15
10

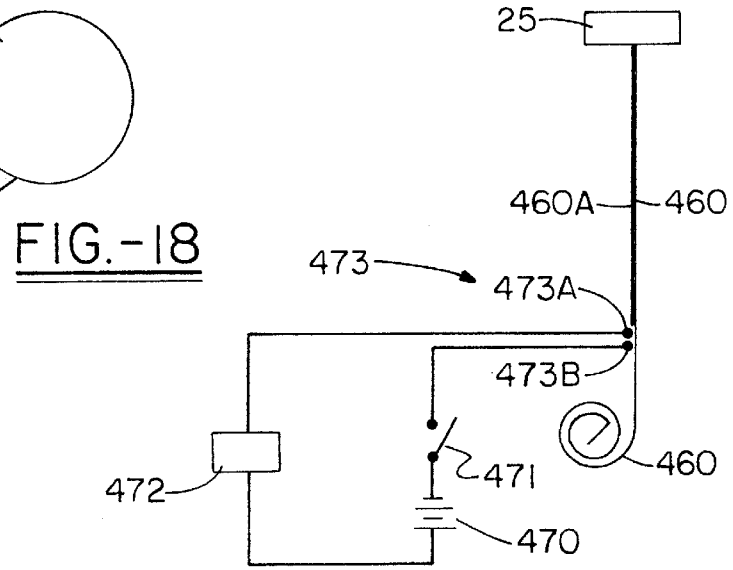
FIG.-18
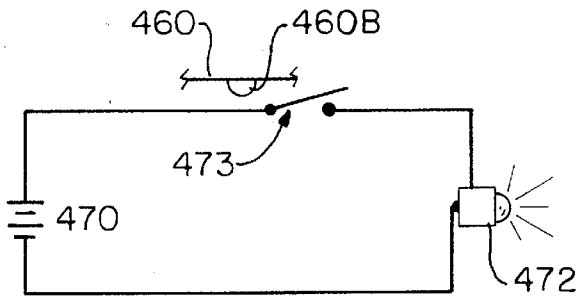
FIG.-19
FIG.-20
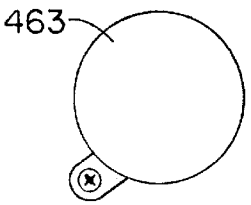
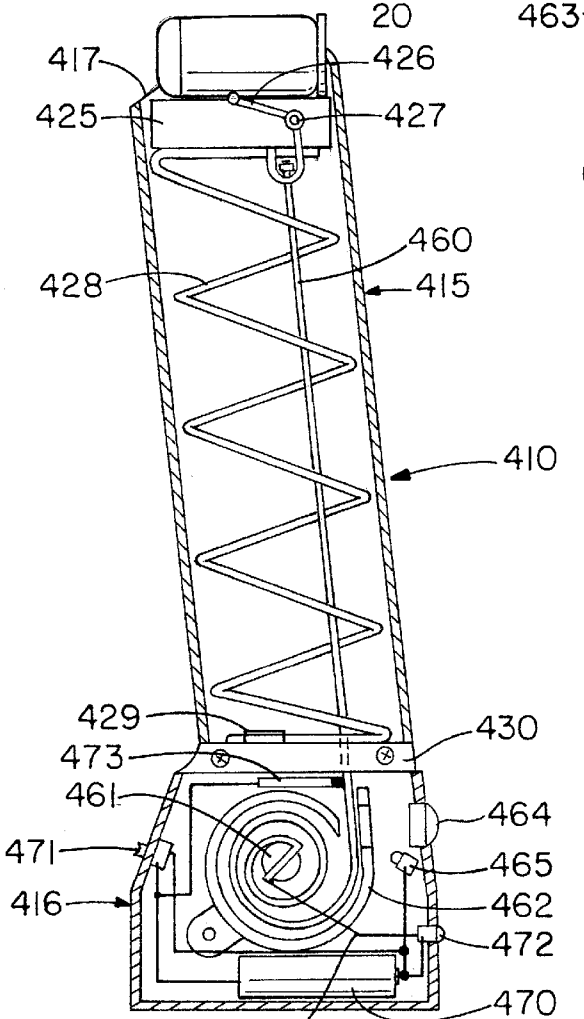
FIG.-17
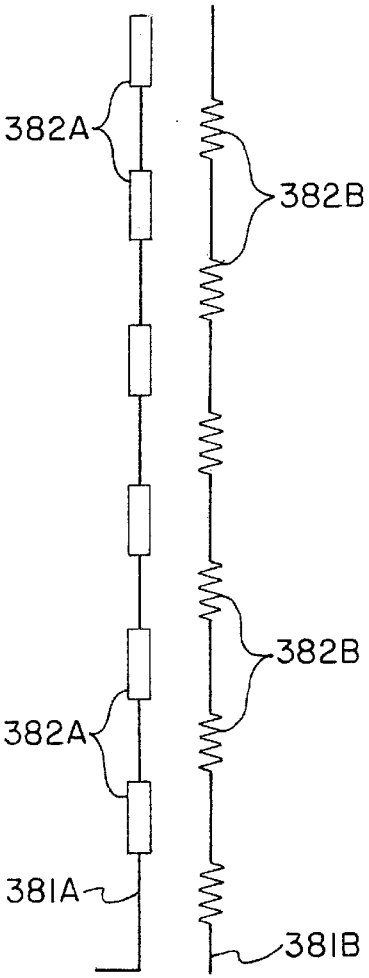
FIG.-16

MAGAZINE FOR A FIREARM INCLUDING A SELF-CONTAINED AMMUNITION COUNTING AND INDICATING SYSTEM

CROSS REFERENCE TO RELATED APPLICATIONS

This application is a continuation-in-part of the following U.S. applications: Ser. No.08/580,080, filed Dec. 20, 1995, now U.S. Pat. No. 5,642,581, issued Jul. 1, 1997. In accordance with 35 USC 119(*e*), this application further claims the benefit of the filing dates of the following provisional applications. Provisional application Ser. No. 60/011,464 filed Feb. 12, 1996 and Provisional application Ser. No. 60/027,576, filed Sep. 30, 1996.

FIELD OF THE INVENTION

The present invention relates to a magazine for a firearm, also known as a "clip", and more particularly to a magazine including a system for sensing the amount of ammunition contained within the magazine (or alternatively, the amount of ammunition missing from the magazine) and indicating that value to the user of the firearm. The counting and indicating system may be configured to display the number of rounds remaining in the magazine itself, or the number of rounds remaining in the firearm overall (the number of ammunition rounds in the magazine plus one round in the chamber of the firearm, if applicable), or it may be configured to simply indicate that the magazine is empty or that the number of rounds remaining in the magazine is below some other predetermined threshold.

BACKGROUND OF THE INVENTION

A common problem associated with the use of firearms, especially automatic or semi-automatic firearms, is the inability of the user to easily and accurately determine the number of ammunition rounds remaining in the magazine or "clip" of the gun. In certain law enforcement and military situations for example, the law enforcement officer or soldier may need to know the precise amount of ammunition remaining in his or her weapon, or at the very least, that the number of rounds remaining is below some predetermined threshold. Also, competitive marksmen, gun enthusiasts and hunters have found a need and a desire for easily and accurately determining the number of live rounds of ammunition remaining in a weapon. A knowledge of the precise number of rounds remaining in a weapon, or an indication that live ammunition is present in the weapon is another safeguard to preventing accidental shootings.

Ammunition counting and display devices for firearms have been developed in an effort to provide law enforcement officers, military personnel, hunters, gun enthusiasts, and others with a mechanism for easily and accurately counting and displaying the number of rounds fired from a weapon, or the number of unfired rounds remaining in the weapon. However, none of these prior devices has proven to be satisfactory for accomplishing either of these tasks. These prior systems have generally been complicated and have all required the firearm itself to be modified in some manner to accept the device. Many of the prior systems must be incorporated at the time the firearm is manufactured or have required modifications to the grip, the slide mechanism, and the magazine mechanism of a weapon. Such modifications and complex installation requirements make it difficult and undesirable for many gun users to utilize these devices. Also, some of the prior devices add an unacceptable amount of bulk and weight to the firearm, resulting in a weapon that is more difficult to holster, aim, and fire.

Many of these prior ammunition counting systems utilize the movement of the slide mechanism of the firearm relative to the body of the firearm to count the number of times the weapon has been fired. There are several disadvantages to this approach. Any modification of the slide assembly, especially by a less experienced gun user, increases the likelihood of the slide assembly becoming jammed or otherwise malfunctioning. Also, these prior system that increment or decrement a counter based upon the movement of the slide necessarily require that the number of rounds initially present in the firearm is properly sensed or entered by the user. For example, one prior system assumes that the magazine will always be fully loaded when it is initially inserted into the weapon and therefore automatically sets the counter to "8" or some other predefined value. The counter is then decreased by "1" each time the slide moves relative to the gun body. It can be seen that should the magazine be loaded with less than eight rounds of ammunition when it is initially inserted in to the weapon, the number of rounds indicated on the display would be inaccurate, resulting in a dangerous and potentially deadly situation.

Another disadvantage with merely incrementing or decrementing a counter based upon movement of the slide mechanism is that should the device fail to properly sense the firing of the weapon, even once, the count will be inaccurate from that point on.

SUMMARY OF THE INVENTION

It is therefore an object of the present invention to provide an ammunition magazine for a firearm including a self-contained system for accurately sensing and indicating the number of rounds of ammunition remaining in the magazine.

It is another object of the present invention to provide an ammunition magazine for a firearm including a self-contained system for accurately sensing and indicating the number of rounds of ammunition in the firearm overall (the number of rounds in the magazine plus the round in chamber of the firearm).

It is a further object of the present invention to provide an ammunition magazine for a firearm including a self-contained system for accurately sensing and indicating the number of unfired ammunition rounds in the magazine, wherein the firearm does not need to be modified to accept the magazine.

It is still another object of the present invention to provide an ammunition magazine for a firearm including a self-contained system for accurately sensing and indicating the number of unfired ammunition rounds in the magazine, wherein the magazine and ammunition counting system do not interfere with the holstering and firing of the firearm.

Additional objects and advantages of the present invention will be set forth in the description which follows.

To accomplish the foregoing and other objects, the present invention comprises an ammunition magazine for use in a firearm, wherein the magazine includes a follower therein for supporting at least one round of ammunition within the magazine and a spring for biasing the follower toward an open end of the magazine. The magazine also includes sensing means for sensing the position of the follower within the magazine and means for determining and indicating the number of rounds of ammunition contained within the magazine based upon the position of the follower.

The means for indicating a number of rounds of ammunition contained within the magazine may be either visual or audible. This indicating means could also be vibratory (tactile) or could take the form of a transmitter which transmits information indicating the number of rounds of ammunition to a remote receiver on the user or even detached therefrom. Visual means, e.g., a display, are currently preferred. Whether visual or audible means for indicating information (e.g., the number of rounds remaining) are used, it is essential that the information be discernible to a user whether the magazine is inserted in or removed from a gun, and without modification of the gun.

As ammunition is fired from the firearm, unfired rounds are taken from the open end of the magazine into the chamber of the firearm while empty ammunition cartridges or shells are ejected from the firearm. The follower therefore moves upward under the force of the follower spring. The sensing means senses the new position of the follower and an indicator element connected to the sensing means determines the number of rounds remaining in the magazine based upon the new position and conveys this information to a firearm user. A preferred means for determining and indicating information to a firearm user comprises an electronic circuit which includes a display element to be viewed by the gun user for displaying the number of rounds of ammunition remaining in the magazine. Alternatively, the numeric display element may be replaced or supplemented by one or more indicator lamps or light emitting diodes that indicate the number of rounds of ammunition remaining in the magazine, or that the number of rounds has fallen below some predetermined threshold (for example, a red indicator light may be used to indicate that the magazine is empty). Other means for indicating to a firearm user information indicating the number of rounds of ammunition are mechanical, and may comprise a coded tape having indicia (e.g., numbers) thereon indicative of the number of rounds remaining, and a display window through which such number or other indicia is displayed. Supplemental or alternate means for indicating information may comprise an audible signal which indicates that the magazine is empty or nearly empty of ammunition. In any case, the means for determining and indicating information must be capable of furnishing such information to a firearm user whether or not the magazine is inserted into a firearm and without requiring modification of the firearm.

In the case where a firearm user fully loads the firearm, including the magazine and also inserts a round of ammunition into the chamber of the firearm, that user may want to increase the displayed count of ammunition by one to account for the round in the chamber. The present invention may therefore comprise means for consistently increasing the indicated amount of ammunition in the magazine by one to accurately indicate the number of rounds in the firearm overall.

BRIEF DESCRIPTION OF THE DRAWINGS

FIG. 16 is a diagrammatic illustration of an alternative resistive membrane switch having discrete contact points.

FIG. 17 is a side view of a magazine according to a still further embodiment of this invention, this embodiment having mechanical only for sensing and displaying the number of rounds of ammunition remaining, with the front wall of the magazine removed.

FIG. 18 is a side view of a cover for the coiled tape of the apparatus shown in FIG. 17.

FIG. 19 is a schematic diagram of the supplemental electrical indicator associated with the apparatus of FIG. 17.

FIG. 20 is a schematic diagram of a modified form of supplemental electrical indicator which may be used with an apparatus as shown in FIG. 17.

DETAILED DESCRIPTION OF THE INVENTION

Figure 3:
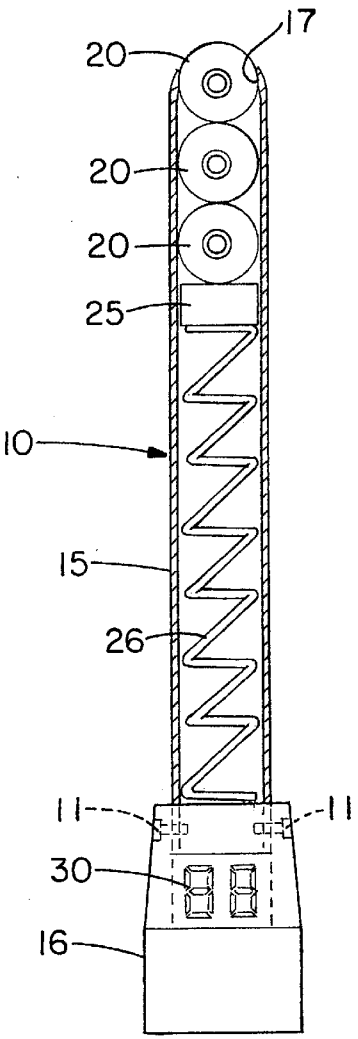
FIG. 3 is a rear view, partially in cross section and partially in elevation of the ammunition magazine shown in FIG. 2.

Reference will now be made in detail to the present preferred embodiments of the invention, examples of which are illustrated in the accompanying drawings. Wherever possible, the same reference numbers will be used throughout the drawings to refer to the same or like parts.

Referring specifically to FIGS. 1–4, an ammunition magazine in accordance with the present invention, also known as a clip, is shown generally at 10 as it may be used in conjunction with a firearm such as a semi-automatic handgun 12 as shown. The firearm 12 comprises a firing chamber 13 and a hand grip 19 having a lower butt portion 14. The hand grip 19 is hollow so that it can receive a magazine 10. The hollow interior of hand grip 19 may be generally rectangular in shape. A rectangular shape is preferred and this shape will be assumed in the ensuing description of an ammunition magazine in accordance with this invention. The firearm 12 may be conventional and the hand grip 19 may be (and preferably is) windowless.

A magazine 10 in accordance with the present invention may be used with any firearm designed to accept a magazine or "clip" such as automatic and semi-automatic handguns and rifles, shotguns, and any other suitable firearm. Magazine 10 comprises a generally hollow upper storage portion 15 for containing a quantity of live ammunition rounds 20 such as bullets, cartridges, or shells. Magazine 10 further comprises a lower portion 16, which may be attached or joined to the upper portion 15. The upper portion 15 of magazine 10 is adapted to be inserted into the hollow interior of handle grip 19 of firearm 12. The upper portion 15 and the lower portion 16 of magazine 10 may be rectangular in shape, the lower portion 16 being slightly larger in size than the upper portion 15 so as to form a shelf 16*a* generally coinciding with or limiting the extent of insertion of magazine 10 into the hand grip 19 of firearm 12. Magazine 10 further includes a generally open top portion 17 at the upper end of upper portion 16. The lower portion 16 of magazine 10 remains outside the firearm 12 and therefore visible to a user when the magazine 10 is inserted into a firearm 12.

A gun user loads ammunition 20 into upper portion 15 of magazine 10 by pressing the cartridges or shells 20 downward into magazine 10 through a generally open top portion 17 as is well known in the field of firearms and ammunition magazines.

Hollow upper portion 15 of magazine 10 includes an ammunition follower 25, which is slidably positioned within hollow upper portion 15, for supporting the one or more rounds of ammunition 20 within upper portion 15 of magazine 10. Follower 25 is biased upward toward open top 17 of magazine 10 by a follower spring 26, and as ammunition rounds 20 are loaded into magazine 10, follower 25 is forced downward toward lower portion 16 of magazine, thereby compressing follower spring 26. After magazine 10 is inserted into firearm 12, firearm 12 is cocked, causing a round of ammunition 20 to be automatically removed through open top 17 of magazine 10 and positioned within the firing chamber 13 of firearm. Follower 25 simultaneously moves upward under the force of follower spring 26, thereby positioning a new round of ammunition 20 at open top 17 of 5 magazine 10. At this point, if desired, magazine 10 may be once again removed from firearm 12 and an additional round of ammunition 20 may be inserted into open top portion 17 of magazine 10 before it is reinserted into firearm 12. Firearm magazine 10 will then be completely full, and a live round of ammunition 20 will also be present in chamber 13. This state, when chamber 13 contains a live round of ammunition 20, and when magazine 10 is also fully loaded, will hereinafter be referred to as the "plus one" state.

When the firearm 12 is fired, the empty ammunition cartridge is ejected from firing chamber 13, and a new round of ammunition 20 is automatically taken from open top 17 of magazine 10 and positioned in chamber 13. Follower 25 moves upward under force of follower spring 26 a distance equal to the width of the round of ammunition 20 removed from open top 17 of magazine 10. Firearm 12 may be repeatedly fired in this manner, and follower 25 will correspondingly move incrementally upward as described. It can be seen therefore that the location of follower 25 within hollow upper portion 15 of magazine 10 depends upon the number of ammunition cartridges 20 stored in magazine 10. It can also be seen that for any number of ammunition cartridges 20 loaded in upper portion 15 of magazine 10 (from zero to fully loaded) follower 25 will assume a unique position within upper portion 15 of magazine 10.

Figure 2:
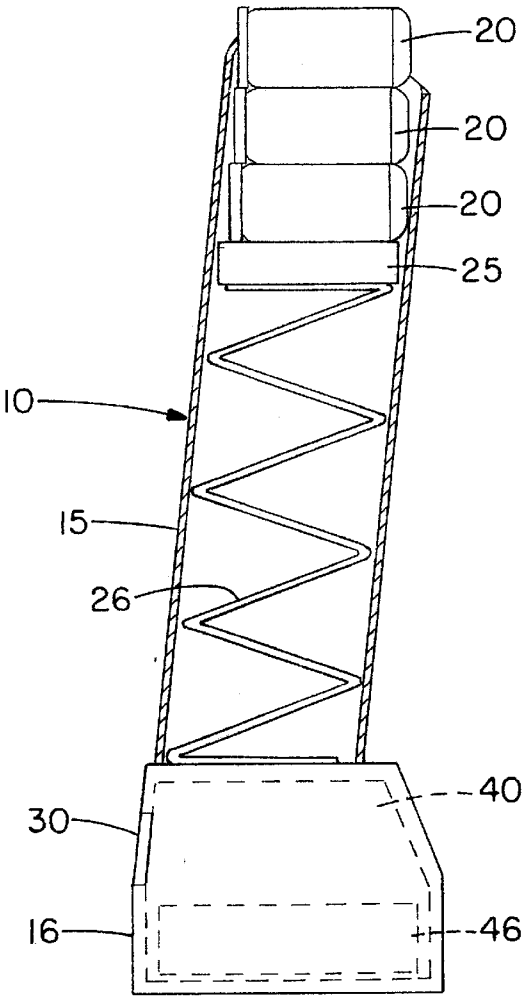
FIG. 2 is a side view in cross section of an ammunition magazine in accordance with the present invention.
Figure 1:
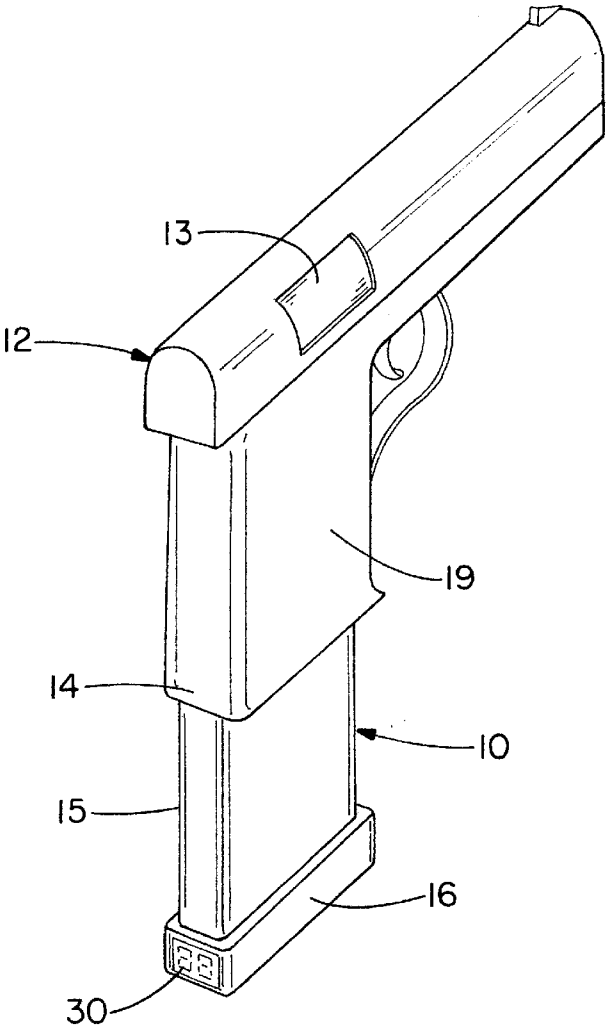
FIG. 1 is perspective view of a firearm including an ammunition magazine in accordance with the present invention.

As shown in FIGS. 2 and 3, lower portion 16 of magazine 10 is attached to hollow upper portion 15 using fasteners such as screws 17*a*, although any other suitable method of attachment may be utilized and is contemplated herein. Alternatively, upper portion 15 and lower potion 16 of magazine 10 may be manufactured as an integral one-piece unit. When magazine 10 is inserted into firearm 12, only the lower portion 16 of magazine 10 extends from the lower butt portion 14 of the firearm handgrip 19. Lower portion 16 of magazine 10 includes a visual display 30 which is preferably rearwardly facing (relative to the direction of bullet travel from the firearm) so as to be easily viewable by the gun user. Visual display 30 is preferably a two digit, seven-segment light emitting diode (LED) display or a similar liquid crystal display (LCD). Visual display 30 is positioned and oriented such that a gun user can easily read the numbers displayed thereon with the gun in a wide variety of positions, including the aiming/firing position. As is discussed in more detail below, display 30 is part of an electronic circuit means contained within lower portion 16 of magazine 10 for determining the number of rounds of ammunition 20 present in the magazine 10 based upon the position of follower 25. The electronic circuit means is also configured to drive the display element 30 thereof such that the number of rounds of ammunition 20 within magazine 10 is visually displayed to the gun user.

Figure 4:
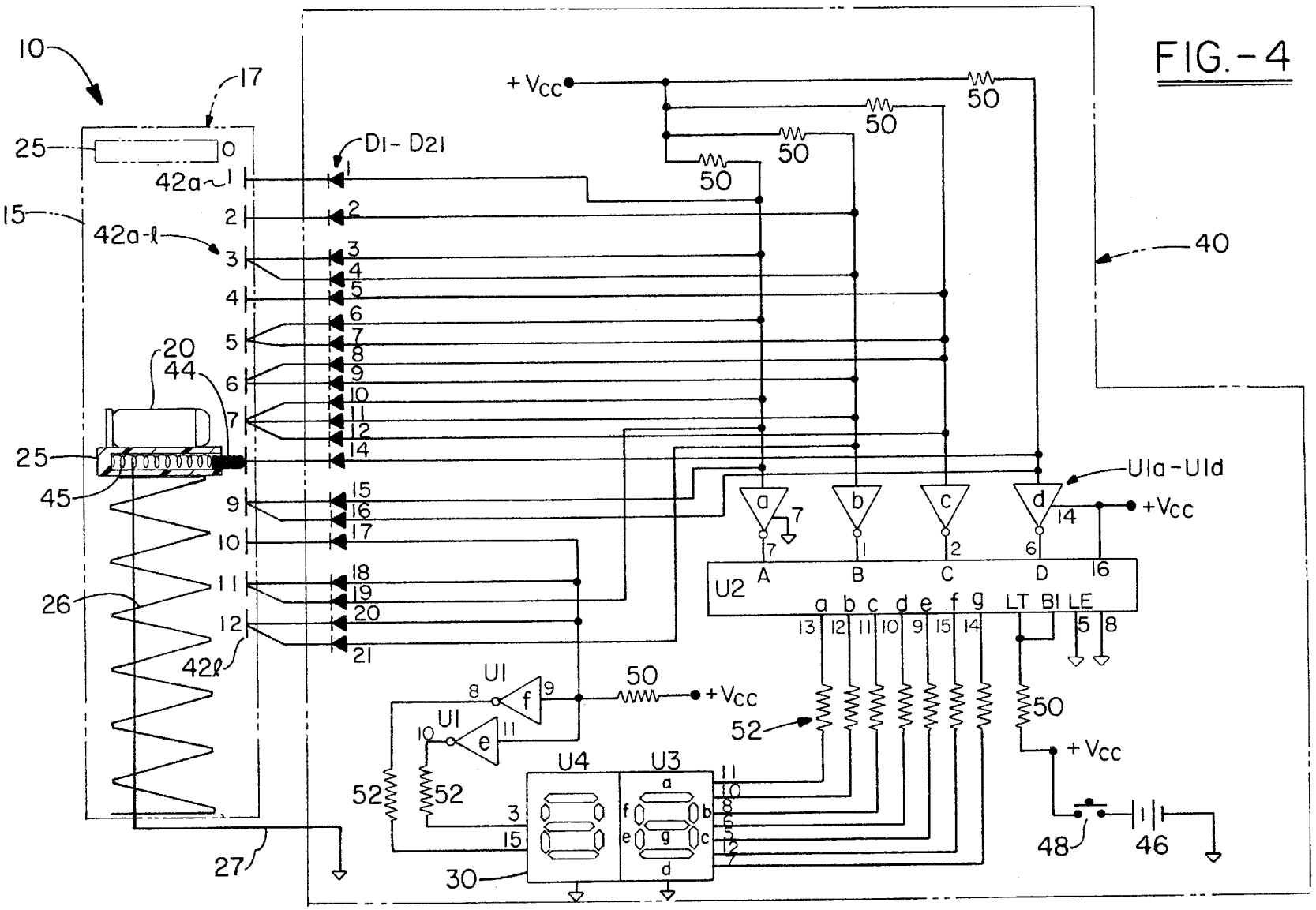
FIG. 4 is a schematic diagram of an electronic circuit that may be incorporated into an ammunition magazine in accordance with the present invention.

Referring now also to FIG. 4, the first embodiment of the present invention is shown schematically at 10. Upper portion 15 of magazine 10 includes sensing means, connected to an electronic circuit 40 (discussed fully below), for sensing the position of follower 25 within upper portion 15 of magazine 10. In the example shown in FIG. 4, the sensing means is provided, in part, by a plurality of contacts 42*a*–42*l* preferably corresponding in number to the total number of rounds of ammunition capable of being loaded into upper portion 15 of magazine 10. Each contact 42*a*–42*l* is electrically insulated from upper portion 15 of magazine 10 which is typically metallic. Follower 25, which is preferably made of an electrically non-conductive material, also includes a contact 44, which forms part of the sensing means for sensing the position of follower 25, and which is preferably a spring-loaded sliding contact 44 which is designed to contact one of contacts 42*a*–42*l* when follower 25 is adjacent thereto. Spring-loaded contact 44 includes a spring 45 which urges contact 44 into engagement with contacts 42*a*–42*l*. Spring-loaded sliding contact 44 is electrically connected to ground using a ground wire 27 or by insulating follower spring 26 and using spring 26 to connect spring-loaded contact 44 to ground potential. Contacts 42*a*–42*l* are also preferably positioned in upper portion 15 of magazine 10 such that for any number of rounds of ammunition 20 loaded into upper portion 15 of magazine 10, one contact 42*a*–42*l* will be adjacent to and contacted by sliding c sliding contact 44 with one of contacts 42*a*–42*l* at each discrete location of follower 25 can be exploited in a variety of ways to determine and display the number of rounds of ammunition 20 within magazine 10. In the example shown, contact 42*a* corresponds to the position of follower 25 when one round of ammunition 20 is present in upper portion 15 of magazine 10. Likewise, contacts 42*b*–42*l* correspond respectively to the position of follower 25 when 2–12 rounds of ammunition 20 are present in upper portion 15 of magazine 10. When upper portion 15 of magazine 10 is empty, follower 25 will be positioned at the open top 17 of upper portion 15 (as is shown in phantom at 25), such that none of contacts 42*a*–42*l* will be connected to spring-loaded contact 44, resulting in the digit "0"being displayed on display element 30.

As shown in FIG. 4, for example, an electronic circuit 40 is provided, preferably within lower portion 16 of magazine 10. As shown herein, circuit 40 includes a voltage source 46 such as one or more batteries. A switch 48 may be provided for selectively connecting voltage source 46 to circuit 40. For example, switch 48 may be positioned such that it is closed automatically when magazine 10 is inserted into firearm 12. Alternatively, switch 48 may be selectively activated by the gun user to connect voltage source 46 to circuit 40 such that display 30 selectively displays the number of rounds of ammunition within magazine 10. When switch 48 is closed, voltage source 46 provides a voltage (Vcc) to components of circuit 40.

Display 30, in the example shown, comprises two Panasonic LN524GK seven segment LED display elements U3 and U4. As shown herein, display element U3 must display the "ones" digit of the display 30 and consequently must be capable of displaying any digit 0–9. Input pins (11,10,8,6, 5,12,7) of display element U3 (each being connected to and controlling one of the seven segments a–g of the display element) are therefore respectively connected to output pins (13,12,11,10,9,15,14) of a 74HC4511 Binary Coded Decimal (BCD) to seven segment decoder driver U2, or an equivalent through current limiting 220 Ohm resistors 52. Display element U4 is designed to display the "tens" digit of display 30 and therefore is needed only if magazine 10 has a capacity of greater than nine rounds of ammunition 20.

BCD to seven segment decoder driver U2 is connected to (Vcc) at input pin 16, while input pins 5 and 8 thereof are tied to ground to establish a logic "low", and input pins LT and BI are pulled to logic "high" by connection to Vcc through a 1 Megohm "pull-up" resistor 50. Decoder driver U2 includes four logic inputs (A,B,C,D) which correspond respectively to BCD bits $2^0$,$2^1$,$2^2$,$2^3$ such that, for example, when inputs A and D of decoder driver U2 are at a logic level "high"and inputs B and C of decoder driver U2 are at a logic "low" (indicating a value of $2^0+2^3$ at the inputs (A,B,C,D), decoder driver U2 will establish the proper logic voltage levels at its output pins (13,12,11,10,9,15,14) such that the decimal value corresponding to the BCD value of $2^0+2^3$, which is 9, is displayed by display element U3. Each logic input pin (A,B,C,D) of decoder driver U2 is respectively tied to (Vcc) through an inverter U1*a*–U1*d*, each of which invertors U1*a*–U1*d*is preferably provided as part of an inverter chip package U1 consisting of 6 invertors U1*a*–U1*f*, such as an MM74HC14 Hex Inverting Schmitt Trigger, and the respective input pin (13,5,3,1) each a inverter U1*a*–U1*d* is initially pulled to a logic "high" by connection to (Vcc) through 1 Megaohm pull-up resistors 50. Inverter package U1 is tied to Vcc at input pin 14 thereof and to ground at output pin 7 thereof.

Display element U4 will preferably be blank or will display the digit "1" as required, and therefore its connection to the remainder of circuit 40 is more simple than the connection of display element U3. However, those skilled in the art will recognize that display element U4 may be connected in a manner similar to display element U3, or an equivalent manner, to display any digit "0"–"9". As shown in FIG. 4, element U4 has input pins 3 and 15, which are connected to and control segments b and c thereof, connected through current limiting resistors 52 to inverters U1*e*,U1*f*, respectively, each of which inverters U1*e*,U1*f* is also preferably provided as a part of inverter package U1. The respective input pins 11,9 of inverters U1*e*,U1*f* are connected to (Vcc) through a 1 Megaohm pull-up resistor 50 to establish a logic "high" at inputs 9,11, thereby also establishing a logic "low" voltage level at their respective outputs 8,10 and inputs 3,15 of display element U4 (assuming less than 9 rounds of ammunition 20 are present in upper portion 15 of magazine 10).

Referring again to upper portion 15 of magazine 10, it can be seen that each contact 42*a*–42*l* is tied to the cathode of at least one diode (D1–D21). The anode of each diode (D1–D21) is to tied to an input (1,3,5,13,9,11) of inverters (U1*a*,U1*b*,U1*c*,U1*d*,U1*f*,U1*e*). It can be seen that, for example, contact 42*a* will be contacted by spring-loaded contact 44 of follower 25 when one round of ammunition 20 is present in magazine 10. In order to display a "1" on display element U3 when follower 25 is in this position as described, input A of BCD decoder driver U2 must be a logic "high" requiring the input 13 of inverter U1*a* to be pulled "low". The remaining inputs (B,C,D) of decoder driver U2 should remain low, and therefore, the inputs (5,3,1) to their respective inverters U1*b*–U1*d* need to remain "high". Consequently, contact 42*a* must only be tied to one diode D1. Anode of diode D1 is tied to input 13 of inverter U1*a* such that when spring-loaded sliding contact 44 of follower 25 is adjacent to and contacting contact 42*a*, thereby pulling input 13 of inverter U1*a* to a reference potential or logic "low"voltage, input A of decoder driver U2 will be pulled "high" by virtue of its connection to output pin 12 of inverter U1*a* causing a "1" to be displayed on display element U3. The remaining contacts 42*b*–42*i* are likewise configured and connected to inputs 1,3,5,13 of inverters (U1*d*,U1*c*,U1*b*, U1*a*) such that the required inputs 1,3,5,13 of inverters (U1*d*,U1*c*,U1*b*,U1*a*) are pulled "low" due to a connection between spring-loaded contact 44 and one of contacts 42*b*–*i*. As is discussed above, one or more diodes D1–D16 are connected between contacts 42*a*–42*i* such that current flows from (Vcc) to ground through pull-up resistors 50 when contact is made between spring-loaded contact 44 and one of contacts 42*a*–42*i*. Using the particular configuration shown in FIG. 4, the number of diodes that need to be connected to each contact 42*a*–42*i* is equal to the number of connections needed between each contact 42*a*–42*i* and inputs (1,3,5,13) of inverters (U1*d*,U1*c*,U1*b*,U1*a*). Those skilled in the art will recognize that the number of connections needed between each contact 42*a*–42*i* and inputs (1,3,5,13) of inverter package U1 is equal to the number of "1" bits needed in the BCD bit pattern for each digit ("1"–"9" respectively) that must be displayed by display element U3. As another example, shown in FIG. 4, follower 25 will be adjacent to contact 42*h* when 8 rounds of ammunition 20 are present in magazine 10 (only one round of ammunition 20 is shown). The digit "8" is encoded in BCD as "1000" which represents $2^3$. Therefore, the only inverter of package U1 that needs to be affected is U1*d*. Electrical connection between spring-loaded contact 44 and contact 42*h* pulls input pin 1 of inverter U1*d* to a logic "low" voltage state, thereby causing input D of decoder display chip U2 to be pulled "high". The input pins (A,B,C) of decoder driver U2 will not be affected and will remain "low". Therefore, decoder driver chip U2 will cause the value of $2^3$ or "8" to be displayed on display element U3. In general therefore, it can be seen that for each position of follower 25 within upper portion 15 of magazine 10, a unique input voltage pattern to circuit 40 will be provided from the sensing means such as contacts 44 and 42*a*–42*l*. Circuit 40 can interpret each unique voltage pattern as discussed above to display the number of rounds of ammunition 20 present in magazine 10.

When more than 9 rounds of ammunition 20 are present in magazine 10, display element U4 must be utilized to provides a "tens" digit to the display 30. In the example shown, display element U4 will remain blank when 0–9 rounds of ammunition 20 are present within magazine 10. However, in a manner similar to that described above in relation to display element U3, display element U4 will display the digit "1" when follower 25 is adjacent to any of contacts 42*j*–42*l* as will occur in the present example when magazine 10 contains 10, 11, or 12 rounds of ammunition 20, respectively. It can be seen that each contact 42*j*–42*l* must also be connected to the appropriate input pins 1,3,5,13 of inverter package U1, as is discussed above, to cause the proper "ones" digit to be displayed simultaneously with the tens digit "1". Contact 42*j*, which will be contacted by spring-loaded contact 44 when 10 rounds of ammunition 20 are present in magazine 10 is not connected to any of the input pins (1,3,5,13) of inverter package U1 because, when 10 rounds of ammunition 20 are present in magazine 10, the "ones" digit that needs to be displayed is "0". Each contact 42*j*–42*l* must also be connected to input pins 9,11 of inverter package U1. Inputs 9,11 of inverter package U1 are also connected to (Vcc) through a common 1 Megaohm pull-up resistor 50 to establish an initial logic voltage value of"high" at inputs 9,11 of inverter package U1, and consequently establish a logic "low" voltage level at outputs 8,10 of inverter package U1 and also inputs 3,15 of display element U4 so that display element U4 will initially be blank. However, when spring-loaded contact 44 of follower 25 contacts a contact 42*j*–42*l*, thereby completing a circuit between (Vcc) and ground through a pull-up resistor 50, both inputs 9,11 of inverter package U1, along with the appropriate "ones digit" input pins 1,3,5,13 of inverter package U1, will be pulled to a logic "low" voltage potential. This will cause both inputs 3,15 of display element U4 to be pulled high, resulting in the digit "1" being displayed thereon. Also, the relevant inputs (A,B,C,D) of decoder driver U2 will be pulled to a logic "high" voltage level so that the appropriate "ones" digit is simultaneously displayed on display element U3.

By preventing the reverse flow of current from each contact 42*a*–42*l*, diodes D1–D21 allow each contact 42*a*–42*l* to be multiplexed or connected to more than one input (1,3,5,13,9,11) of inverter package U1. For example, as shown in FIG. 4, when 8 rounds of ammunition 20 are present in magazine 10, input pin 1 of inverter U1*d* is pulled "low" by virtue of the connection between contacts 44,42*h*. Without the presence of diode D16, input pin 1 of inverter U1*d* would be pulled back to "high" due to the connection of contact 42*i* with input pin 1 of inverter U1*d*, and also with (Vcc) at input 13 of inverter U1*a*. Diodes D1–D21 also stop erroneous readings by preventing the metallic ammunition cartridges 20 stacked on follower 25 (only one shown) from accidentally establishing an improper voltage level at one of the inputs (1,3,5,13) of inverter package U1. For example, as is shown in FIG. 4, a voltage potential (Vcc) exists at all contacts except 42*h* which is grounded. If a metallic ammunition cartridge 20 was to contact any contact 42*a*–42*g*, 42*i*–42*l*, that ammunition cartridge 20 and any others touching it would be connected to (Vcc). If a second contact 42*a*–42*g*, 42*i*–42*l* was then contacted by an charged ammunition cartridge 20, an improper voltage level at inputs (1,3,5,13) of inverter package U1 could result. Diodes D1–D21 therefore prevent a voltage potential from being established at inputs 1,3,5,13 by virtue of their connection to an accidentally charged round of ammunition 20 and contact 42*a*–42*l*. Also, those skilled in the art will recognize that an ammunition magazine 10 in accordance with the present invention may be provided with a switch for consistently increasing the displayed value by one so that a gun user can selectively increase the displayed number of rounds of ammunition 20 in the firearm 12 by one to account for the situation where the firearm includes a fully loaded magazine 10 as well as a round of ammunition 20 in the chamber, or any other situation where the gun user desires that the total number of rounds of ammunition 20 in the firearm 12 be displayed, rather than simply the number of rounds of ammunition 20 in the magazine 10.

Figure 6:
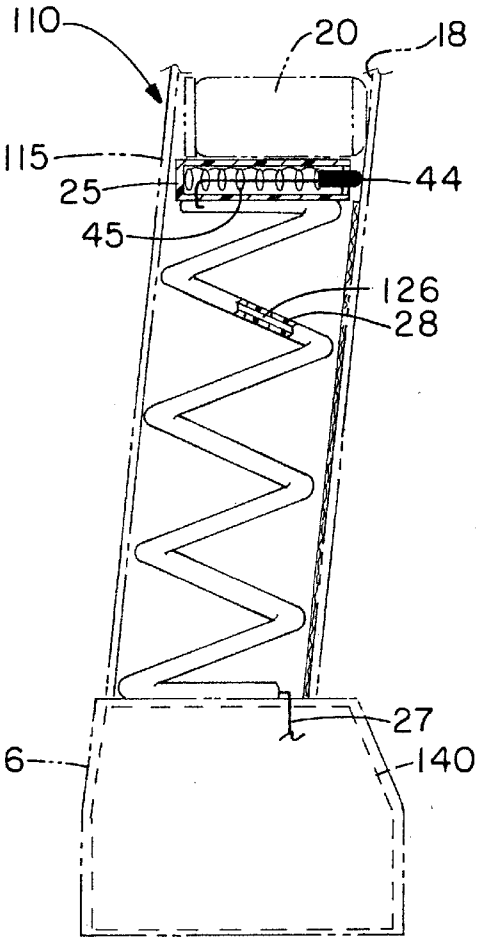
FIG. 6 is partial schematic view of an alternative embodiment of the present invention.
Figure 5:
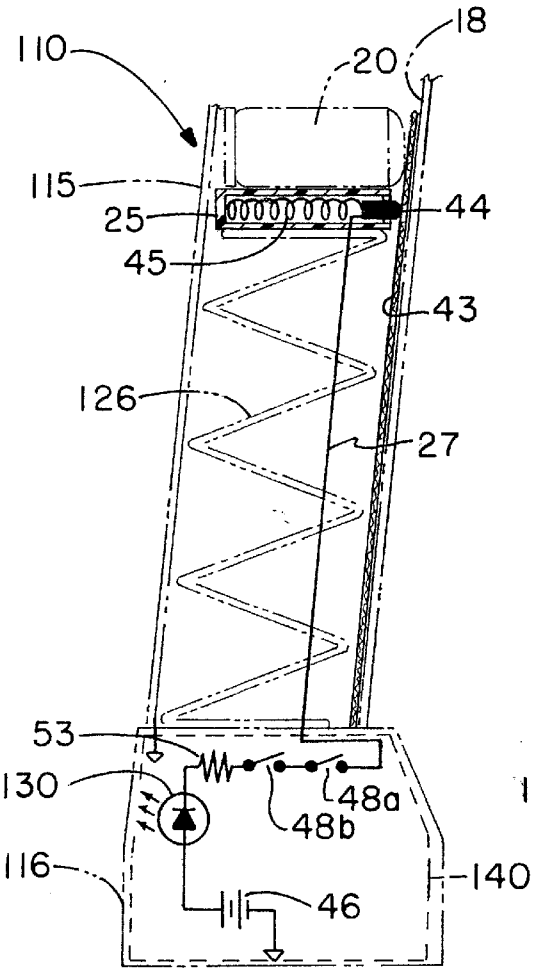
FIG. 5 shows a schematic view of an alternative embodiment of the present invention.

A simplified embodiment of the present invention is shown schematically at 110 in FIG. 5 wherein upper portion 115 of magazine 110 is electrically connected to ground potential as shown and follower 25 is equipped with a spring-loaded contact 44 which is electrically tied to an electronic circuit 140 through an electrical current conducting path such as a wire 27. Alternatively, as is shown in FIG. 6, metallic follower spring 126 may be insulated with any suitable insulating material 28 to form an electrical current path 27 to circuit 140 such that springloaded contact 44 may be electrically connected to circuit 140 directly through follower spring 126. Although not required, follower spring 126 may be specially shaped to minimize contact with metallic upper portion 115 of magazine 110, such that friction between insulation 28 of spring 126 and upper region 115 of magazine 110 is minimized. Insulation 28 may be provided in any suitable form, and it is thought preferable to provide insulation 28 in one or more cylindrical plastic or similar segments as shown rotatably positioned around spring 126 to further minimize friction between insulation 28 and upper portion 115 of magazine 110. In all other respects, magazine 110 shown in FIG. 5, and that partially shown in FIG. 6 are identical.

Referring then to lower portion 116 of magazine 110, it can be seen that lower portion 116 includes an electrical circuit 140 including a display element 130 designed to indicate to the gun user when the level of ammunition 20 within upper portion 115 of magazine 110 has dropped below a predetermined level or threshold. Circuit 140 preferably includes one or more switches 48*a*,48*b* such that a gun user can selectively control the operation of circuit 140. For example, one of switches 48*a*,48*b* can be positioned and configured to close automatically when magazine 110 is inserted into firearm 12, and the other of switches 48*a*,48*b* can be operable by the gun user to selectively operate circuit 140. In this manner, circuit 140 will be inoperable unless magazine 110 is properly inserted into firearm 12. In the example shown, display element 130 is provided by an LED which will turn on and off (illuminate or extinguish) depending upon the number of rounds of ammunition 20 present in upper portion 115 of magazine 110.

In general, it can be seen that spring-loaded contact 44 moves up and down within upper portion 115 of magazine 110 in conjunction with follower 25. Spring-loaded contact 44 includes a spring 45 which constantly urges contact 44 toward inner wall 18 of upper portion 115. Inner wall 18 includes an exposed portion which acts as a second contact and those skilled in the art will recognize that any time contact 44 touches an exposed portion of wall 18 (or any other non-insulated part of upper portion 115) circuit 140 will be completed (assuming switches 48*a*,48*b* are closed) thereby providing an alternative means for sensing the position of follower 25 within upper portion 115 of magazine 110. When circuit 140 is completed, LED 130 will illuminate. A current limiting resistor 53 is provided in circuit 140 to prevent excessive current from flowing therethrough. Therefore, as shown in FIGS. 5 and 6, an insulator material such as insulating strip 43 is positioned along an interior portion of wall 18 of upper portion 115 of magazine 110 to selectively prevent contact 44 from contacting wall 18. In the example shown, it can be seen that LED 130 will remain unlighted any time upper portion 115 contains sufficient rounds of ammunition 20 such that follower 25 is pushed downward within upper portion 115 so that it is adjacent to insulator strip 43. As rounds of ammunition 20 are emptied from upper portion 115, follower 25 is pushed upward by follower spring 126. It can therefore be seen that contact 44 will contact wall 18 at some predefined point where strip 43 ends, and wall 18 is exposed. As shown, LED 130 will illuminate when upper portion 115 is approximately half empty. However, by changing the length of insulating strip 43, any other predetermined illumination point can be defined. For example, insulating strip 43 can be sufficiently long such that LED 130 will not illuminate until upper portion 115 of magazine 110 is empty. Also, magazine 110 can be configured where LED 130 is normally illuminated and becomes extinguished at a certain predefined level of ammunition 20.

Figure 7A:
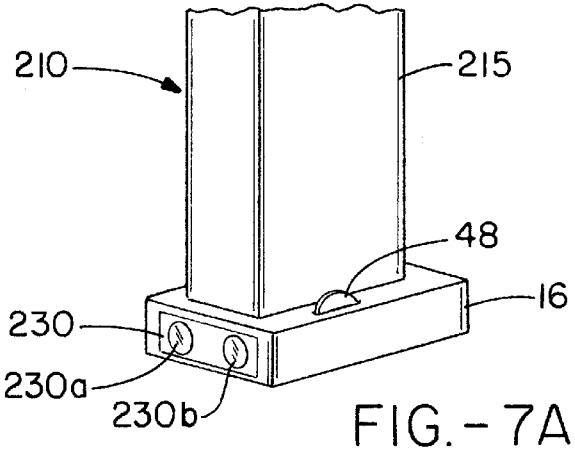
FIG. 7A is a partial perspective view of another alternative embodiment of an ammunition magazine in accordance with the present invention.
Figure 7B:
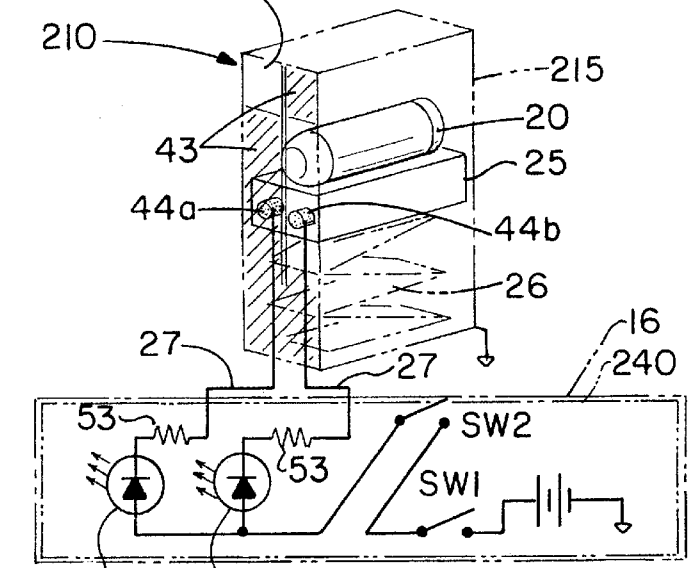
FIG. 7B is a partially schematic, partially perspective view of the ammunition magazine shown in FIG. 7A.

FIGS. 7A and 7B show a further variation of a magazine in accordance with the present invention at 210 which is closely related to magazine 110 wherein follower 25 includes two spring-loaded contact 44*a*,44*b*, each respectively connected to a separate LED 230*a*, 230*b* using current conducting wires 27. As is shown most clearly in FIG. 7B, inner wall 18 of upper portion 215 includes an insulation strip 43 which is shaped and positioned such that spring-loaded contacts 44*a*,44*b* will contact wall 18 at various different positions of follower 25 within upper portion 215. LED's 230*a*, 230*b* are therefore preferably different in color such that the gun user can easily distinguish therebetween. In the example shown, it can be seen that both LED's 230*a*, 230*b* will remain unlighted when magazine 210 is full or nearly full and follower 25 is positioned approximately in the lower half of magazine 210. As rounds of ammunition 20 are taken from magazine 210, follower 25 will move upward as previously discussed. Insulating strip 43 is shaped such that when upper portion 215 of magazine 210 is approximately half empty, spring-loaded contact 44*b* will be moved into contact with wall 18 thereby completing a path for electrical current to flow through LED 230*b*. As follower 25 continues to move upward to a point where upper portion 215 is emptied of ammunition 20, spring-loaded contact 44*b* will once again be prevented from contacting wall 18 due to the placement of insulating strip 43 (causing LED230*b* to extinguish), while spring-loaded contact 44*a* will be able to contact wall 18 due to the lack of any insulating strip 43 adjacent to contact 44*a* when follower 25 is at the uppermost position, thereby lighting LED 230*a* and indicating to the gun user that magazine 210 is empty.

Figure 8A:
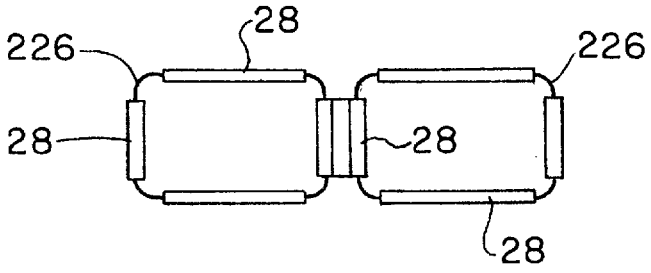
FIGS. 8A and 8B are a top plan view and a side elevational view, respectively, of an insulated electrically conductive follower spring that may be utilized in conjunction with the ammunition magazine shown in FIGS. 7A and 7B.
Figure 8B:
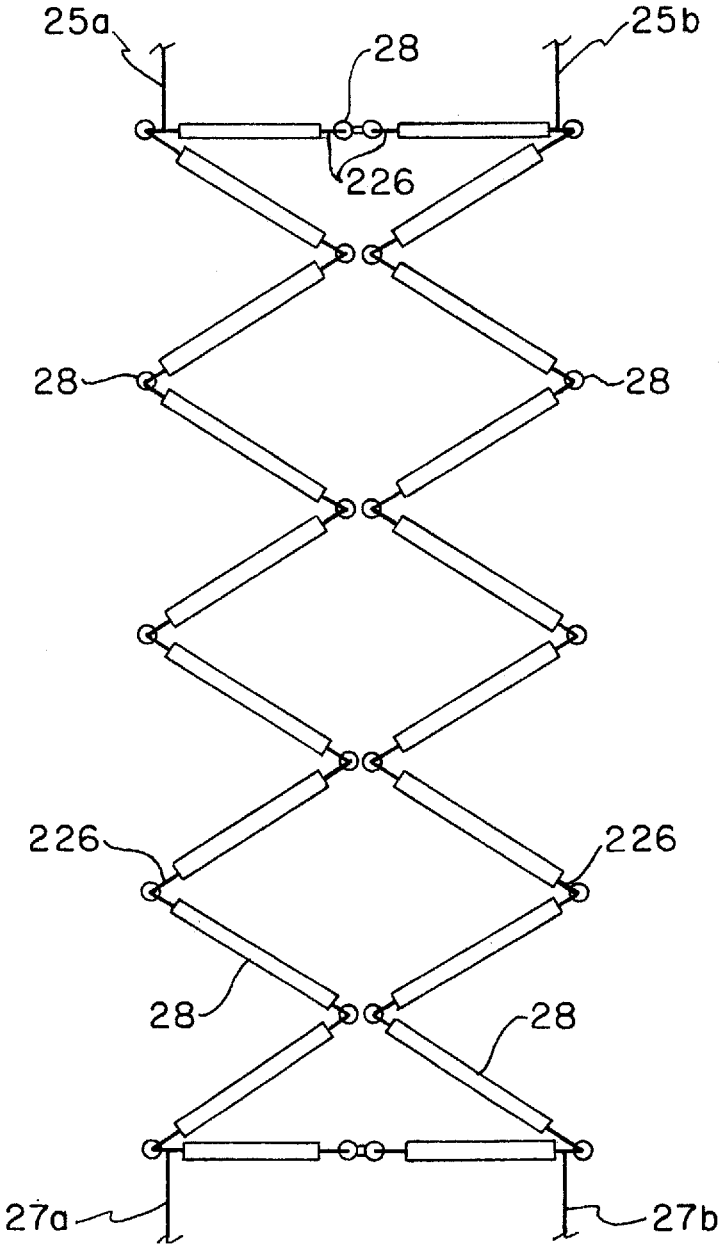

As is shown in FIGS. 8A and 8B, insulated follower spring 226 may be used in conjunction with the magazine 210 as an alternative to wire 27 to connect spring-loaded contacts 44*a*,44*b* with circuit 240 in a manner similar to that described in relation to insulated spring 126. Because follower 25 of magazine 210 includes two separate spring-loaded contact 44*a*,44*b*, follower spring 226 includes two separate current conducting paths 27*a*,27*b* which are insulated from one another and from upper portion 215 of magazine 210 by insulators 28.

It can be seen from the foregoing that the present invention provides an ammunition magazine for a firearm including a self-contained system for accurately sensing and displaying the number of ammunition rounds remaining in the magazine, without requiring the firearm to be modified. Those skilled in the art will recognize that various modifications can be made to the present invention as disclosed herein without departing therefrom. For example, any mechanical contacts could easily be replaced using Hall effect sensors or optical means for sensing the position of the follower within the ammunition magazine. Also, any wired connections could be replaced with wireless connections such as optical, sonic, radio frequency, or other similar wireless connections. A wide variety of different electrical components and connections may be utilized in addition to the particular preferred embodiments as disclosed herein. In general, the foregoing description has set forth the preferred embodiment of the invention in particular detail and it must be understood that numerous modifications, substitutions and changes can be undertaken without departing from the true spirit and scope of the present invention as defined by the ensuing claims.

A further embodiment of this invention will now be described with reference to FIGS. 9–16. This embodiment may utilize both electrical and mechanical means to sense the number of rounds of ammunition in a magazine and to indicate that number. The mechanical means is a back up and is optional.

Figure 10:
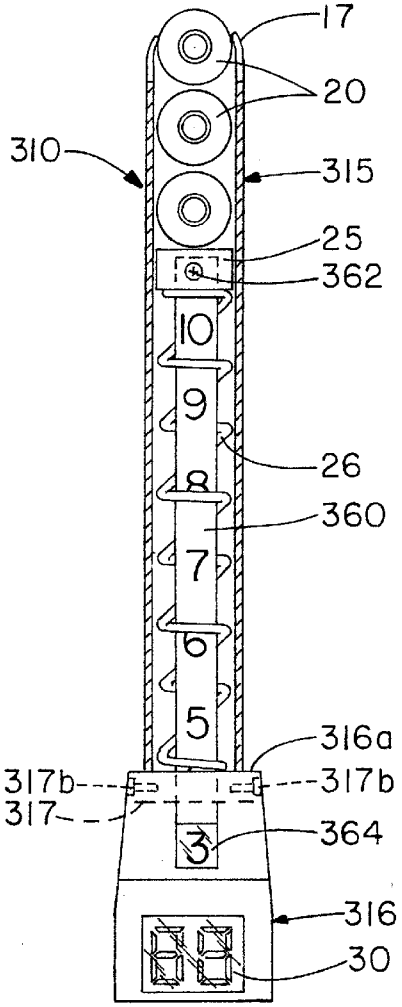
FIG. 10 is a rear view of the apparatus shown in FIG. 9, with the sidewall removed to show the interior of the magazine.
Figure 9:
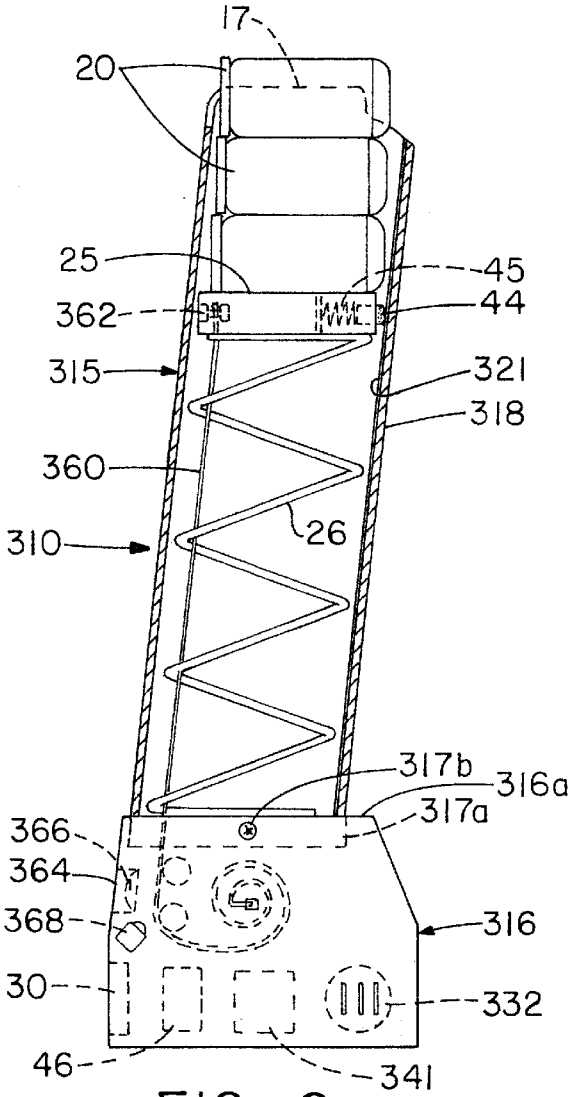
FIG. 9 is a side view of a magazine according to a still further embodiment of this invention, this embodiment having electrical means with mechanical backup means for sensing and displaying the number of ammunition rounds remaining with the front wall of the magazine removed to show the interior of the magazine.

Referring now to FIGS. 9 and 10, magazine 310 comprises a hollow upper portion 315 which is adapted to contain live ammunition rounds 20, and a lower portion 316. Upper portion 315 is adapted to be inserted into a firearm 12, and lower portion 316 remains outside the firearm 12 when the upper portion 315 is inserted. Lower portion 316 may be joined or attached to upper portion 315 by suitable means, e.g., by means of a universal adaptor bottom 317*a* having engagement screws 317*b*. The lower portion 316 of magazine 310 is slightly larger in cross-sectional area than the upper portion 315, forming a shelf 316*a* which coincides with or acts as a limit stop to prevent insertion of the lower portion 316 of magazine 310 into a firearm.

Upper portion 315 terminates at a separate end and an open top 17, which may be like that shown in FIGS. 2 and 3.

Upper portion 315 may be of desired cross-sectional shape, e.g., rectangular (and in any case corresponding to the shape of a cavity in a firearm 12 which receives a magazine 310). A generally rectangular upper portion 315 has four vertical side walls, including a slotted sidewall 318 and (preferably) three imperforate sidewalls (un-numbered). Each of the sidewalls, including the slotted sidewall 318, has an exterior surface and an interior surface.

Figure 12:
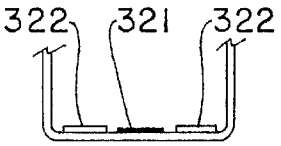
FIG. 12 is a diagrammatic top view of a portion of the apparatus shown in FIG. 11, illustrating a resistive membrane switch and spacers on either side thereof.
Figure 11:
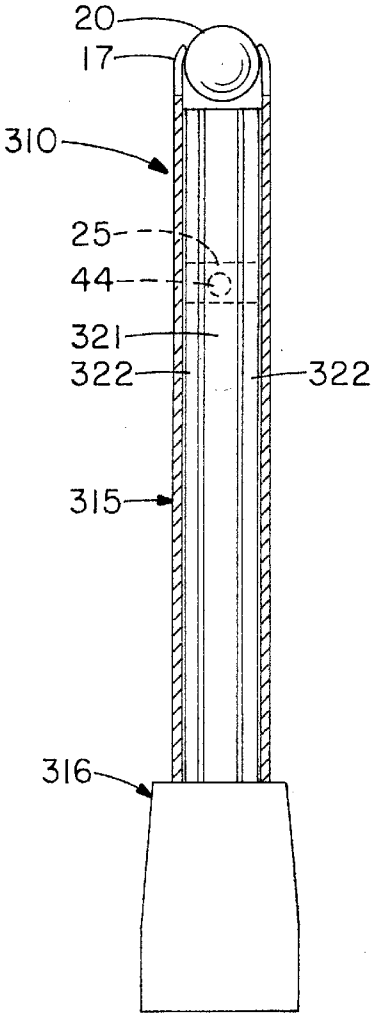
FIG. 11 is a front view of a magazine according to the embodiment of FIG. 9 with certain components omitted.

Sidewall 318 has three vertically extending slotted cutouts for receiving an electrically conductive resistive membrane switch (RMS) 321 flanked by a pair of spacers 322 on either side thereof, as best seen in FIGS. 11 and 12. RMS 321 and spacers 322 are all in the form of long, narrow and thin rectangular strips. The two spacers 322 are thicker than the RMS 321. RMS 321 and spacers 322 are mounted in their respective openings in sidewall 318 so that the respective outer faces of RMS 321 and both spacers 322 lie in a common plane, as shown in FIG. 12. The inner face of RMS 321 lies outwardly of the inner faces of spacers 322, also as shown in FIG. 12.

Inside the hollow upper portion 315 of magazine 310 is a follower 25, which is biased upwardly by follower spring 26. This moves rounds of ammunition 20 upwardly into the open top 17 of magazine 310 and from there into the firing chamber 13 of firearm 12, in the manner described with reference to FIGS. 1–3.

Magazine 310 has sensing means for sensing the position of follower 25 within the upper portion 315 of the magazine 310. To this end, follower 25 includes a spring loaded siding contact 44, and which is biased outwardly by spring 45 so as to make sliding contact with the inner surface of RMS 321. Spacers 322 engage the outer walls or casings of ammunition 20 in the upper portion 315 of magazine 310.

Resistive membrane switch (RMS) 321 comprises a thin conductive metal contact strip 321A and a resistive element 321B, which may be a coating/film having appreciable and uniform resistivity. Thin non-conductive outer layers or surfaces 321D and 321E are provided on the outer surfaces of metal contact strip 321A and resistive element 321B, respectively.

Figure 13A:
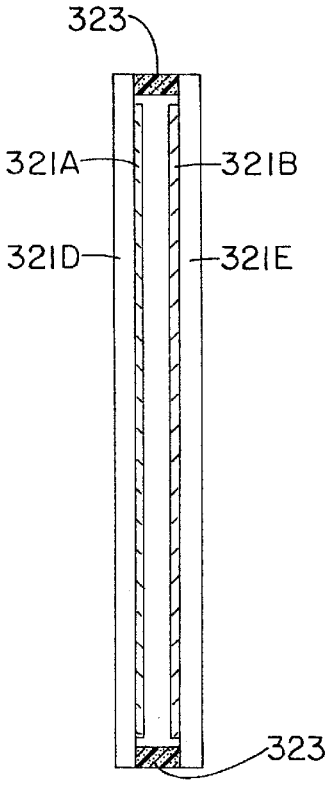
FIG. 13A is a cross-sectional view of the resistive membrane switch.
Figure 13B:
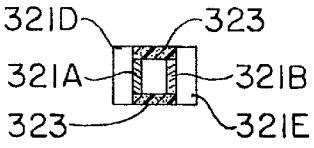
FIG. 13B is an end view of the resistive membrane switch illustrated in FIG. 13.

Thin metal contact strip 321A and resistive element 321B both run the length of RMS 321 and are spaced apart by non-conductive spacers 323, as shown in FIGS. 13*a* and 13*b*.

Figure 14:
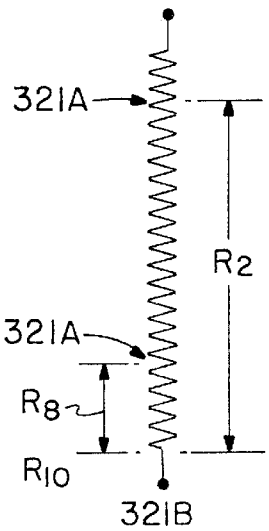
FIG. 14 is an electrical diagram of the resistive membrane switch when different numbers of bullets are present in the magazine.

Sliding contact 44 of follower 25 contacts the outer surface 321D which is attached to the metal contact strip 321A of RMS 321, pressing it against the resistive element or coating/film 321B. As rounds of ammunition 20 are fired, the point of contact between the metal contact strip 321A and the resistive element 321B moves upwardly, increasing the effective resistance of resistive coating/film 321B, as shown diagrammatically in FIG. 14. Referring to FIG. 14, when the point of contact between metal contact 321A and resistive element 321B is in its lowest position, corresponding to a full "clip" of ten rounds of ammunition for illustration purposes, the resistive element 321B has a minimal resistance $R_{10}$. Since the power source and electronic source (to be described) are housed in the lower portion 316 of magazine 310, only the portion of resistive element 321B which lies below the point of contact with metal strip 321A is in the circuit. By way of further example, when eight rounds of ammunition remain, contact between metal contact strip 321A and resistive element 321B is at an intermediate level, also as shown in FIG. 14, affording an effective resistance $R_8$ in the resistive element 321B. When only two rounds of ammunition remain, contact is at an upper level, affording an effective resistance $R_2$.

Referring back to FIGS. 9 and 10, a digital readout device or other desired indicator element (an audible indicator for example), housed in the lower portion 316 of magazine 310, indicates the number of rounds of ammunition remaining. This digital readout 30 may be like that shown in FIGS. 2 and 3. An audible indicator 332, which may be a digital sound recorder and play back device, may also be provided if desired, for use either in addition to or instead of digital readout 30. The lower portion 316 of magazine 310 may also contain an electronic circuit 340 (to be described later with reference to FIG. 15*a*), formed on chip 341, for processing information as to the location of follower 25, and hence the number of rounds of ammunition remaining in magazine 310, and a power source 46 such as a battery.

Figure 15A:
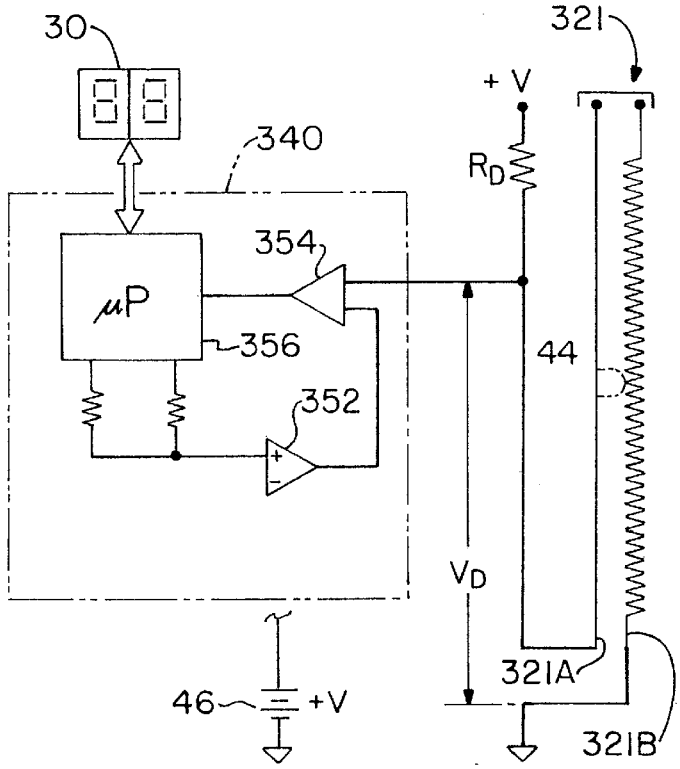
FIG. 15A is an electrical circuit diagram illustrating a resistive membrane switch and required to translate resistance changes in the basic functional block required to translate resistance changes in the resistive membrane switch into information displayed.

An electronic circuit 340 for processing information as to the number of rounds remaining is shown in FIG. 15*a*. In FIG. 15*a*, all grounds are denoted by the conventional symbol and by the reference letter G.

First, a resistor divider is formed by RMS 321 and a resistor Rd. RMS 321 is connected between a circuit ground and the resistor Rd. Resistor Rd (which is a fixed resistance) is also connected to a positive voltage source, e.g., the positive terminal of battery 46, having a voltage value V+. RMS 321 may be grounded in the manner shown in FIG. 5, e.g., by a ground wire attached to follower contact 44. Since both RMS 321 and the negative terminal of battery 46 are grounded, a complete circuit is formed.

The voltage that develops at Vd (voltage divider), which is the junction between RMS 321 and fixed resistance Rd, is proportional to the increase or decrease in resistance that is evoked in RMS 321 via the follower 25 moving in magazine 310. The voltage Vd is also dependent on the voltage V+. The voltage Vd is measured by a function block 340, which is an electronic circuit which translates the measured voltage level Vd into a corresponding indication such as a number count of how many shells (or rounds of ammunition 20) are in magazine 310. This indication or signal may be either visible or audible, e.g., a sound indication, a vibration indication, or a light/lamp indication (such as an LED as previously described for displaying the number of shells that remain, or simply a light which is lit when the number of shells remaining falls below a certain value).

The electronic circuit or function block 340 can consist of any one of many different types of apparatus for measuring resistance levels of the RMS 321. A voltage divider is the most basic. A preferred electronic circuit or function block 340, herein shown in FIG. 15*a* by way of example, comprises a summing amplifier (op-amp) 352 (or U1) a comparator 354 (or U2) and a microcontroller 356 (or U3). The microcontroller generates a series of outputs such that when summed through scaling resistors elements $R_x$ in conjunction with the use of summing amplifier 352, a unique voltage at the output of the summing amplifier 352 can be formed.

The micro controller measures the voltage Vd by use of a simple comparator 354 that is fed voltage Vd, and a voltage generated by the microcontroller 356, via the use of one or more resistance elements $R_x$ and summing amp 352 (U1). The voltage controlled by the microcontroller is incremented up in a stairway fashion until this voltage is different enough from the other comparator voltage input (Vd) that the comparator (354) output voltage switches, thus signaling to the micro controller that a near voltage match has been found. The micro controller then translates this measured value into a desired indication means. The micro controller or functional block 340 needs to account for changes in supply voltage V+. The actual functional block 340 should use a ratio metric type measurement to automatically account for V+ changes. An output signal, indicative of a voltage level Vd, which in turn is indicative of the position of follower 25 and therefore the number of rounds of ammunition present, is fed to a desired signaling or indication device, such as a digital readout 30.

Referring back to FIGS. 9 and 10, magazine 310 may be further provided with mechanical means for forming a further indication as to the number of rounds remaining. This mechanical means includes a tape 360, which is a recoiling spring tape which is coiled at one end and flat at the other. The tape may be made of any material capable of accomplishing the purposes of the invention, including but not limited to carbon fiber and steel. The first or coiled end is fixedly secured within the lower portion 316 of magazine 310. The second end is fixedly secured to the follower 25 by means of a steel tape retaining screw 362. This second end and the flat portion of the tape 360 approximate thereto move up and down as the follower 25 moves up and down.

This portion of the tape has indicia thereon, which as shown in FIG. 10 may be numbers indicating the number of rounds of ammunition remaining. This tape may be similar, for purposes of illustration, to a steel measuring tape. For viewing the number of rounds remaining, a window 364 is provided in a wall of the lower portion 316 of magazine 310. This window may be provided with a magnifier lens 366. As a further aid to reading the indicia on the tape, an LED or light bulb 368, and on/off switch for light 368, and a battery to power the light 368, may also be provided.

The mechanical indicator just described may be used either in additional to (as a backup) or instead of the electrical means described earlier.

FIG. 16 shows schematically a modified form of resistive membrane system (RMS) which can be used with the embodiment of FIGS. 9–15. In FIG. 16, 381 is a resistive membrane switch having a conductive strip 381 A and a resistive strip 381B. Conductive strip 381A has thereon a plurality of contacts 382A, equal to the number of rounds of ammunition which can be held in magazine 315. Resistive strip 381B has thereon a plurality of resistors 382B in series, connected by conductive links (unnumbered). The number of resistors 382B is equal to the number of rounds of ammunition which can be held in magazine 310. The conductive strip 381A may replace a conductive strip 321A of RMS 321, as shown in FIG. 13; the resistive strip 381B replaces the resistive strip 321B of RMS 321. The conductive strip 381A and the resistive strip 381B are separated by spacers 323 as shown in FIG. 13. The remaining components of an apparatus employing RMS 381 may be the same as has been described in reference to FIGS. 9–15.

Figure 15B:
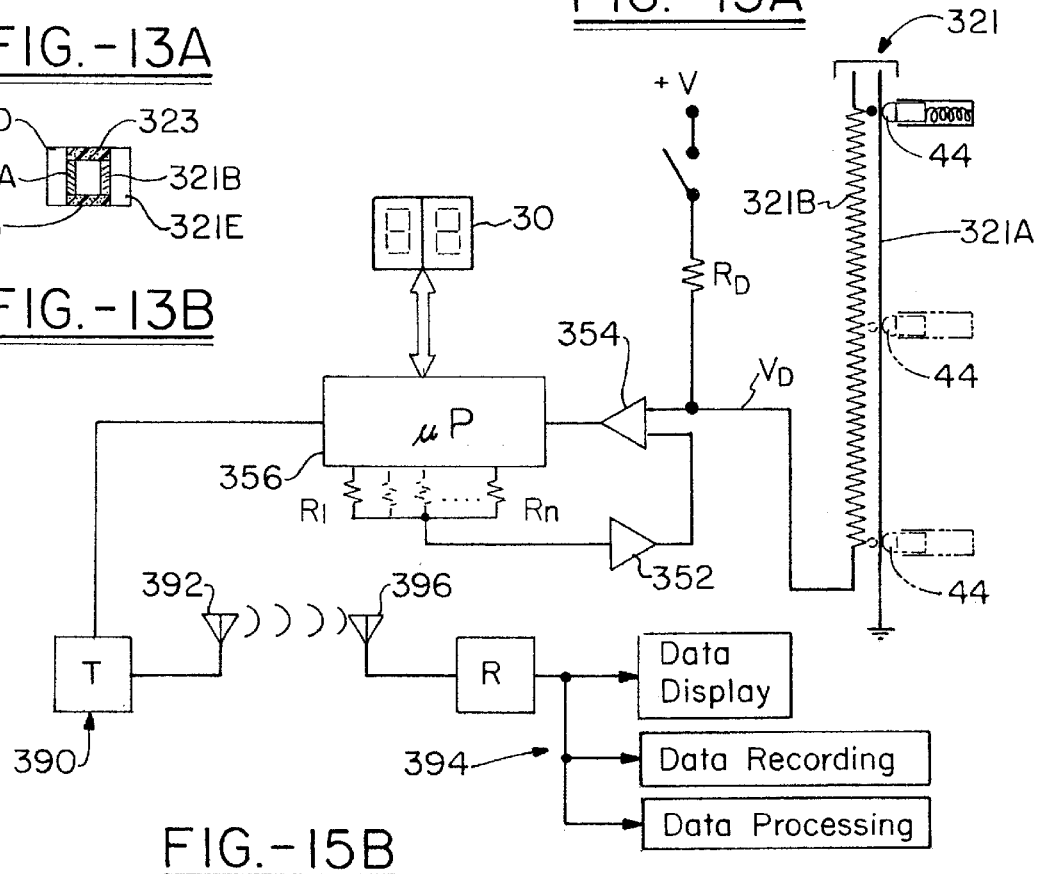
FIG. 15B is an electrical circuit diagram similar to that illustrated in FIG. 15A and incorporating a transmitter/receiver indicating means.

A further modification to this embodiment, illustrated in FIG. 15*b*, includes the incorporation of a transmitter 390, serving as a primary or auxiliary display or indicating means to communicate information concerning the number of rounds remaining in the firearm to a receiver 394 at a location removed from the firearm. Receiver 394 could be attached or connected to the firearm user, for instance on a watchband or other location in plain view of the user during use of the firearm. Alternatively, receiver 394 could be in possession of a partner, team coordinator or headquarters in a peace officer or military application. Such a system could be used to provide increased nonverbal communication between military personnel or peace officers in applicable situations or could be utilized to alert the partner, team coordinator or headquarters anytime a round of ammunition is discharged from a monitored firearm for purposes of summoning backup support, verifying an individual's recounting of a particular situation etc.

Similar to the circuit shown in FIG. 15*a*, a unique voltage Vd is generated via the voltage divider that is formed via resistor Rd and the resistive strip resistance. The actual value of Vd is related to the position of the bullet follower within the magazine. As the follower changes position so does the location of the pressure that is applied to the resistive strip. As such the resistive strip's measured resistance changes, as related to the connection leads. Thus a different value of Vd will occur for different locations of the follower and thus different levels of rounds within the magazine.

Vd is fed to a first input of the comparator 354. Second input of comparator 354 is derived via microcontroller 356, working under its programmed control, the scaling resistors Rx–Rk, and finally summing amplifier 352. It should be noted that the microcontroller functional block's logic 1 output voltage levels vary directly with the voltage level of +V; (i.e. as +V drops X % over time the logic 1 output voltage also drops by X %). This allows the circuit operation to work in a ratio metric modal, thus removing the effects normally associated with voltage level reduction related battery operated equipment. Microprocessor 356 generates a series of logical outputs into the scaling resistors Rx–Rk, these scaling resistors are typically of different values—normally scaled in a binary power series such as 2^0, 2^1, . . . 2^7, though other scaling methods are possible and contemplated. The resulting summation of the current flow though each resistor is summed and buffered via the summing amplifier. The output of the summing amplifier, over time, appears as a stair case wave form which is incremented up from a low voltage to a maximum voltage approaching +V (the voltage of the power supply). The output of the comparator will toggle as the voltage of the summing amplifier reaches and passes the present voltage from the resistive divider-voltage Vd. Since the voltage generated via the summing amplifier is controlled by the microcontroller (via its control of the logic level presented to the scaling resistors) the microcontroller can detect at exactly which level the summer amplifier's output voltage level causes the comparator's output to change logic states. The processor uses this level information to determine programmatic ally what round count information to be used to drive the noted display. This round count information can be directed to a radio frequency transmitter, noted as Tx block 390.

The radio frequency transmitter 390 then sends the required signal to antenna 392. Antenna 392 in turn broadcasts the information via radio frequency waves. These RF waves are then detected by receiver 394 (external to the firearm magazine) via antenna 396. Receiver 394 then extracts the transmitted round count information and passes this data to other external function blocks such as data displays, data recorders or data processors to display or store the transmitted information.

A still further embodiment of the invention shown in FIG. 17 and 18 utilizes a primarily mechanical sensing and indicating mechanism in place of the electronic mechanisms which have been illustrated so far. The device shown in FIG. 17 and 18 are similar although not identical to the mechanical sensing and indicating backup mechanisms shown in reference to FIGS. 9–15.

Referring now to FIG. 17, 410 is a magazine comprising a main body portion (or upper portion) 415, a base housing (or lower portion) 416, and an open top 417 that serves as a bullet carrier. The upper portion or main body portion (or main body 415) of magazine 410 is preferably of rectangular cross section and is hollow.

The lower portion 416 of magazine 410 is likewise hollow and of rectangular cross section, and is slightly larger in cross section than the main portion 415 so as to form a limit stop, preventing insertion of the lower portion 416 into a gun when the upper portion 415 is so inserted.

A bullet carrier or follower 425, here shown in its uppermost position, is slidably mounted within the upper portion 415 of magazine 410. This bullet carrier or follower supports rounds of ammunition in a fashion similar to that described with reference to previous embodiments. A one-piece spring steel tape hook 426 is pivotally mounted on tape hook retaining pin 427 within the bullet carrier 425.

A spring 428 urges the follower or bullet carrier 425 to the upper most position shown in FIG. 17. This spring is anchored at one end (its upper end) on the follower 425 and is at its other or lower end by means of a spring retaining clip 429 just above the lower portion 416 of magazine 410.

A bottom end piece 430 is interposed between the main (or upper) portion 415 and the lower portion 416 of magazine 410. This bottom end piece may slide along a channel at the bottom of the hollow magazine body 415, and is locked into place by means of a projecting bump on the bottom side of the spring retaining clip 429, thus keeping it locked in place once it has been slid into the hollow magazine body. The bottom end piece 430 also has screw holes for attaching the bottom tape housing.

A coated tape 460, which is a thin, self-recoiling tape having numbers or codes thereon for indicating the number of rounds of ammunition remaining, is coiled at its lower end and is anchored at its upper end to the follower 425. This tape has an uncoiled portion which extends straight and vertically through the magazine body 415. This straight portion has thereon codes or indicia indicating the number of rounds of ammunition remaining.

The lower end of tape 460 is received in a slot in a retainer rod 461, which is pivotally mounted within the lower portion or bottom housing 416 of magazine 410. A retainer 462 holds the tape in its wound position. A tape retainer cover 463 (shown broken away and separately in FIG. 18) is attached to the retainer 462 for holding the tape 460 in position. This retainer cover fits over the coiled portion of tape 460.

Indicia on tape 460 are viewed through a window 464, which is similar to its counterpart shown in FIGS. 9 and 10. A magnifier or other type of image enhancer may be used in conjunction with this window if desired. An illumination device 465, which may be a light bulb, LED, or other type of light emitting device, may be provided in order to illuminate the coded tape 460.

A battery 470 is used to power the illumination device 465. An on/off switch 471 controls the supply of power from the battery 470 to the illumination device.

The indicia on tape 460, and the manner in which a number indicative of the number of rounds of ammunition remaining, may be the same as that shown in FIG. 10.

The apparatus of FIG. 17 may be provided with a supplemental electrical indicator to let the user know when the number of rounds of ammunition remaining has reached a critical count. This is done by means of a visual or audible signal (the latter including a buzzer, a vibrating pager style vibratory generating device, or other type of audible sound generator) which is activated when a critical count is reached. Referring now to FIGS. 17 and 19, a signaling means 472 (shown here as a light) is connected to one pole (shown here as a positive pole) of a battery (or other power source) 470. This battery may be the same battery which supplies power to illumination device 465, although a separate power source may be used if desired. The auxiliary electrical signal generating device may be further provided with a contact switch 473 (shown in FIG. 17). This auxiliary contact switch may comprise a pair of contacts 473A and 473B, each of which touches the metal tape 460 as shown in FIG. 19. Alternatively, contact switch 473 may comprise a single contact (as shown in FIG. 17) which touches the metal tape 460, with the connection 474 between the signaling device 472 and the retainer rod 461 completing the circuit, as shown in FIG. 17. (A still further alternative is to connect the retaining rod 461 and one terminal of signaling device 472 to ground.) An insulating cover 460A is provided on a portion of one surface of metal tape 460, as shown in FIG. 19. The portion so covered extends from the follower 25 downwardly to a predetermined level or position on the tape such that the contact or contacts 473A, 473B will touch the insulating cover 460A until only a predetermined small number of rounds of ammunition (say 2 rounds) remain. This may be seen in FIG. 19. When this predetermined limit is reached, further upward travel of the tape 460 exposes the non-insulated metal tape 460 to the contacts 473A, 473B, completing the electrical circuit shown in FIGS. 17 and 19 and causing the signaling device 472 to be activated. In a preferred arrangement, a direct positive lead may be made from the positive lead of battery 470 to the positive lead of signaling device 472, as shown in FIGS. 17 and 19. The negative lead of the signaling device 472, instead of being connected to a contact 473A, may instead be connected to the metal tape retainer rod 461. This puts a ground on the coated tape 460. The negative lead extending from the negative terminal of battery 470 may extend to a contact switch 473 as shown in FIG. 17 (or to a contact 473B of such contact switch, as shown in FIG. 19).

An alternative auxiliary electric or backup electrical signaling system for an apparatus as shown in FIG. 17 is illustrated diagrammatically in FIG. 20. In this arrangement, a voltage source such as battery 470 has one terminal connected to a signaling device 472, which may be a light. The other terminal of signaling device 472 is connected to a terminal or pole of contact switch 473. A second terminal or pole of contact switch 473 is connected to a second terminal (say the positive terminal) of power source (say battery) 470. This switch 473 will normally be open so that the signaling device 472 is not actuated. To actuate the signaling device 472, the metal tape 460 may be provided with a protrusion or bump 460B at a predetermined location such as to close switch 473 and thereby actuate the signaling device 472 when a predetermined small number of rounds remain. If desired, a plurality of such protruding bumps 460B may be provided. This system is capable of being completely enclosed in a water tight casing so that it is waterproof.

Either of the backup or auxiliary electrical indicators above explained provides a useful addition to the visible readout in the form of indicia on tape 460 as has been previously described with reference to FIG. 17. If the user fails to observe from indicia on tape 460 (read through window 464) that only a few rounds of ammunition remains, attention will be called to this fact by means of the readily visible or audible indicators emitted by the auxiliary system as has been described.

When the magazine 410 is fully loaded (say with 10 rounds of ammunition), the follower 425 is at the bottom of its travel and numeral "10" appears through window 464. As ammunition is consumed, the follower 425 moves upwardly, successively exposing a lower number through viewing window 464.

FIGS. 17 and 18 illustrate that an entirely mechanical sensing and indicating system or means can be used with a magazine according to this invention. It is also possible to use a mechanical portion only of the system illustrated in FIGS. 9 and 10.

It will be noted that all of the systems and the devices herein shown and described for sensing the number of rounds of ammunition remaining and furnishing a visible or audible indication of that number, are configured so that the indicator (whether visual or audible) is in the lower portion 16(or 116, 216, etc.) of a magazine and thus always discernible, whether the magazine is in a firearm or not. Also, the entire sensing and indicating means is located in the magazine, so that no modification of a conventional firearm is required.

What is claimed is:

1. An ammunition magazine for a firearm, said magazine comprising:

an upper portion for containing at least one round of ammunition, said upper portion of said magazine including an ammunition follower movably positioned therein for supporting said at least one round of ammunition within said upper portion of said magazine, said upper portion of said magazine also including a follower spring for biasing said follower toward an end of said upper portion of said magazine;

sensing means provided as a part of said ammunition magazine for sensing the position of said follower within said upper portion of said magazine; and, electronic indicator means provided as a part of said ammunition magazine and connected to said sensing means for indicating to a firearm user information regarding the number of rounds of ammunition present in said upper portion of said magazine based upon the position of said ammunition follower within said upper portion of said magazine, whereby said ammunition magazine provides a self-contained ammunition counting and display system, independent from a firearm.

2. An ammunition magazine according to claim 1 wherein said electronic means comprise a circuit, including a display element, said circuit provided as a part of said ammunition magazine and connected to said sensing means for determining and displaying to a firearm user information regarding the number of rounds of ammunition present in said upper portion of said magazine based upon the position of said ammunition follower within said upper portion of said magazine, whereby said ammunition magazine provides a self-contained ammunition counting and display system, independent from a firearm.

3. An ammunition magazine for a firearm according to claim 1 wherein said indicator means comprises a transmitter for communicating information from said sensing means to a receiver remote from said firearm.

4. An ammunition magazine according to claim 1, further including auxiliary electrical signal means for indicating to a user when a predetermined small number of rounds of ammunition remain.

5. An ammunition magazine for a firearm, said magazine comprising:

an upper portion for containing at least one round of ammunition, said upper portion of said magazine including an ammunition follower movably positioned therein for supporting said at least one round of ammunition within said upper portion of said magazine, said upper portion of said magazine also including a follower spring for biasing said follower toward an end of said upper portion of said magazine;

sensing means provided as a part of said ammunition magazine for sensing the position of said follower within said upper portion of said magazine; and, indicator means provided as a part of said ammunition magazine and connected to said sensing means for indicating to a firearm user information regarding the number of rounds of ammunition present in said upper portion of said magazine based upon the position of said ammunition follower within said upper portion of said magazine, whereby said ammunition magazine provides a self-contained ammunition counting and display system, independent from a firearm, and wherein said indicator means has a display remote from said firearm.

6. An ammunition magazine for a firearm according to claim 5 wherein said indicating means comprises a transmitter for communicating information from said sensing means to a receiver remote from said firearm.

7. An ammunition magazine according to claim 5 wherein said indicator means comprise electronic means.

8. An ammunition magazine according to claim 7 wherein said electronic means comprise a circuit, including a display element, said circuit provided as a part of said ammunition magazine and connected to said sensing means for determining and displaying to a firearm user information regarding the number of rounds of ammunition present in said upper portion of said magazine based upon the position of said ammunition follower within said upper portion of said magazine, whereby said ammunition magazine provides a self-contained ammunition counting and display system, independent from a firearm.

9. An ammunition magazine according to claim 5, further including auxiliary electrical signal means for indicating to a user when a predetermined small number of rounds of ammunition remain.

10. An ammunition magazine for a firearm, said magazine comprising:

an upper portion for containing at least one round of ammunition, said upper portion of said magazine including an ammunition follower movably positioned therein for supporting said at least one round of ammunition within said upper portion of said magazine, said upper portion of said magazine also including a follower spring for biasing said follower toward an end of said upper portion of said magazine, and a generally open top portion for transferring ammunition from said magazine to said firearm; and a lower portion affixed to said upper portion;

said upper portion being adapted to be inserted into a firearm, and said lower portion remaining outside the firearm at all times;

a coiled tape having thereon indicia of the number of rounds of indicia of ammunition remaining, said coiled tape having a coiled lower end which is received in said lower portion of said magazine, and an upper end attached to said follower; and a window in said lower portion of said magazine permitting a user to view a selected portion of said indicia at all times, the selected portion being indicative of the number of rounds of ammunition remaining.

11. An ammunition magazine according to claim 10, further including auxiliary electrical signal means for indicating to a user when a predetermined small number of rounds of ammunition remain.

12. An ammunition magazine for a firearm, said magazine comprising:

an upper portion for containing at least one round of ammunition, said upper portion of said magazine including an ammunition follower movably positioned therein for supporting said at least one round of ammunition within said upper portion of said magazine, said upper portion of said magazine also including a follower spring for biasing said follower toward an end of said upper portion of said magazine, and a generally open top portion for transferring ammunition from said magazine to said firearm;

sensing means provided as a part of said ammunition magazine for sensing the position of said follower within said upper portion of said magazine; and indicator means connected to said sensing means for indicating information regarding the number of rounds of ammunition present in said upper portion of said magazine.

13. An ammunition magazine according to claim 12 wherein said indicator means comprise electronic means.

14. An ammunition magazine according to claim 13 wherein said electronic means comprise a circuit, including a display element, said circuit provided as a part of said ammunition magazine and connected to said sensing means for determining and displaying to a firearm user information regarding the number of rounds of ammunition present in said upper portion of said magazine based upon the position of said ammunition follower within said upper portion of said magazine, whereby said ammunition magazine provides a self-contained ammunition counting and display system, independent from a firearm.

15. An ammunition magazine for a firearm according to claim 12 wherein said indicator means has a display remote from said firearm.

16. An ammunition magazine for a firearm according to claim 12 wherein said indicating means comprises a transmitter for communicating information from said sensing means to a receiver remote from said firearm.

17. An ammunition magazine according to claim 12, further including auxiliary electrical signal means for indicating to a user when a predetermined small number of rounds of ammunition remain.

* * * * *